US006804887B2

(12) United States Patent
Cheng

(10) Patent No.: US 6,804,887 B2
(45) Date of Patent: Oct. 19, 2004

(54) FOLDABLE KNIFE HAVING A DOUBLE BLADE

(75) Inventor: Yang-Fu Cheng, Taipei (TW)

(73) Assignee: Kantas Products Co., Ltd., Taipei (TW)

( * ) Notice: Subject to any disclaimer, the term of this patent is extended or adjusted under 35 U.S.C. 154(b) by 23 days.

(21) Appl. No.: 10/277,812

(22) Filed: Oct. 23, 2002

(65) Prior Publication Data

US 2004/0078980 A1 Apr. 29, 2004

(51) Int. Cl.[7] ..... B26B 1/04
(52) U.S. Cl. ..... 30/161; 30/155; 7/118
(58) Field of Search ..... 30/161, 155, 160; D8/99; 7/118

(56) References Cited

U.S. PATENT DOCUMENTS

| | | | | | |
|---|---|---|---|---|---|
| 48,194 | A | * | 6/1865 | Mayland | 7/118 |
| 313,414 | A | * | 3/1885 | Freund | 30/408 |
| 521,555 | A | * | 6/1894 | Scheerer | 30/161 |
| 589,737 | A | * | 9/1897 | Miller | 30/161 |
| 589,738 | A | * | 9/1897 | Miller | 30/155 |
| 988,068 | A | * | 3/1911 | Beardsley et al. | 30/161 |
| 1,194,486 | A | * | 8/1916 | Downs | 86/22 |
| 1,644,705 | A | * | 10/1927 | Belcher | 86/22 |
| 2,718,695 | A | * | 9/1955 | Elsener | 30/152 |
| 4,078,272 | A | * | 3/1978 | Mahon, III | 24/186 |
| D302,649 | S | * | 8/1989 | Porsche et al. | D8/99 |
| 5,857,268 | A | * | 1/1999 | Park | 30/146 |
| 5,933,893 | A | * | 8/1999 | Padden | 7/158 |
| 6,101,722 | A | * | 8/2000 | Cheng | 30/155 |
| 6,101,724 | A | * | 8/2000 | Halligan | 30/161 |
| D436,014 | S | * | 1/2001 | Glesser | D8/99 |
| 6,715,209 | B2 | * | 4/2004 | Taylor et al. | 30/155 |

* cited by examiner

*Primary Examiner*—Charles Goodman
(74) *Attorney, Agent, or Firm*—Bacon & Thomas, PLLC

(57) ABSTRACT

A foldable knife. The foldable knife includes a flat handle and two opposite blades pivotably coupled to forward and rear ends of the handle respectively. The handle includes two resilient pieces on two opposite sides, each resilient piece being capable of being pressed by a hand of a user to fold or the resilient piece is urged against a rear end of the blade for locking the blade in a closed or opened position. The knife further includes a protective element disposed on the handle. The protective element has a height sufficient to prevent the cutting edges of the blades from contacting the hand of the user when the blades are in the closed position.

7 Claims, 7 Drawing Sheets

FOLDABLE KNIFE HAVING A DOUBLE BLADE

FIELD OF THE INVENTION

The present invention relates to foldable knifes and more particularly to a foldable knife having a double blade with improved characteristics.

BACKGROUND OF THE INVENTION

A conventional foldable knife is shown in FIGS. 1A and 1B. A blade 1 of the knife tends to loosen or even deform after a long period of time of use. As a result, a gap 21 is formed between the parallel blade 1 and a handle 2 of the knife when the blade 1 has been rotated back to the handle 2 to a closed position. Thus, a tight engagement of the received blade 1 and the handle 2 is impossible. In other words, there is no support of the blade 1 by the handle 2 in this position. Also, the hand of a user tends to be hurt by the sharp blade 1 if a sufficient care is not taken while holding, taking or carrying the knife. Further, the blade 1 itself may be damaged as contacting other objects. Furthermore, in a case that the knife is stored together with other objects, a pointed or flat object tends to insert into the gap 21. Such insertion can gradually enlarge the gap 21 as time goes. And in turn, the above loosening or deformation of the blade 1 may be worse. As an end, the possibility of hurting persons by the knife is increased.

For solving the problem of the well known knife, the inventor of the present application had invented a foldable knife having a single blade. Further, a Taiwanese Utility Model Patent No. 154,901 having the same title was granted to the present inventor by IPO (Intellectual Property Office) of Taiwan Government. The utility model patent is shown in FIG. 2. As illustrated, the foldable knife 3 comprises a flat handle 30, a blade 31 pivotably coupled to a forward end of the handle 30, a central opening through the handle 30, and a resilient piece 32 at a resilient piece 32 at a lower side of the handle 30, the resilient piece 32 having an upward slightly curved end so as to possess an elastic force in a bent state. At the curved end, a stop 33 is formed. The stop 33 is engaged with a rear end 311 of the blade 31 when the blade 31 is fully extended. At this time, the blade 31 is locked in an opened position. There is further provided an elongated protective element 34 along an edge of the handle 30. The protective element 34 has a predetermined height sufficient to prevent a cutting edge 312 of the blade 31 from contacting a foreign object when the blade 31 is in its closed position. As such, the protective element 34 can protect the user's hand (i.e., prevent it from touching the cutting edge 312) while holding, taking, or carrying the knife 3. Further, other objects can also be prevented from contacting the cutting edge 312 when they are stored together with the knife 3. Furthermore, with the provision of the protective element 34, the cutting edge 312 of the blade 31 can be prevented from being damaged by other objects.

It is understood that there is no end of the progress of technology. Also, more people demand high quality, ergonomic, multi-functional, convenient, and personalized products as time evolves. Hence, continuing improvements in the foldable knife are still constantly being sought.

SUMMARY OF THE INVENTION

A primary object of the present invention is to provide a foldable knife comprising a flat handle and two opposite blades pivotably coupled to forward and rear ends of the handle respectively. The handle includes two resilient pieces on two opposite sides, each resilient piece being capable of being pressed by a hand of a user to fold or resilient piece is urged against a rear end of the blade for locking the blade in a closed or opened position. The knife further comprises a protective element disposed on the handle. The protective element has a height sufficient to prevent the cutting edges of the blades from contacting the hand of the user when the blades are in the closed position. Hence, the protective element can prevent the user's hand from being hurt by the cutting edges while taking or carrying the knife. Further, other objects can also be protected (i.e., prevent they from being hurt by the cutting edges) when they are stored together with the knife. Furthermore, with the provision of the protective element, the cutting edges itself can be prevented from being damaged by other objects. By utilizing this foldable knife having a double blade, it is possible of overcoming the above drawbacks of the prior art.

Another object of the present invention is to provide a foldable knife having a double blade wherein one blade has a sharp cutting edge and the other blade has a series of sharp teeth in its edge. With the variety of cutting edges, the foldable knife of the present invention can be readily adapted to applications.

The above and other objects, features and advantages of the present invention will become apparent from the following detailed description taken with the accompanying drawings.

DETAILED DESCRIPTION OF THE PREFERRED EMBODIMENTS

Figure 1A:
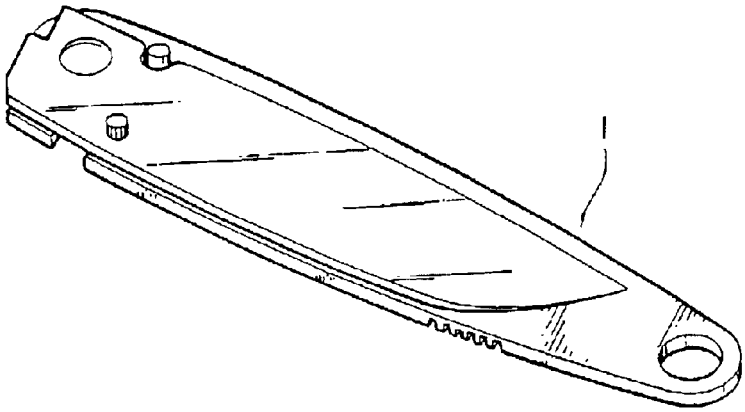
FIG. 1A (Prior Art)
FIG. 1A is a perspective view of a conventional foldable knife.
Figure 1B:
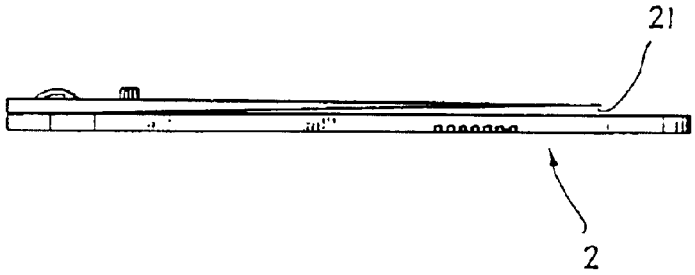
FIG. 1B (Prior Art)
FIG. 1B is a side view of the FIG. 1A knife.
Figure 2:
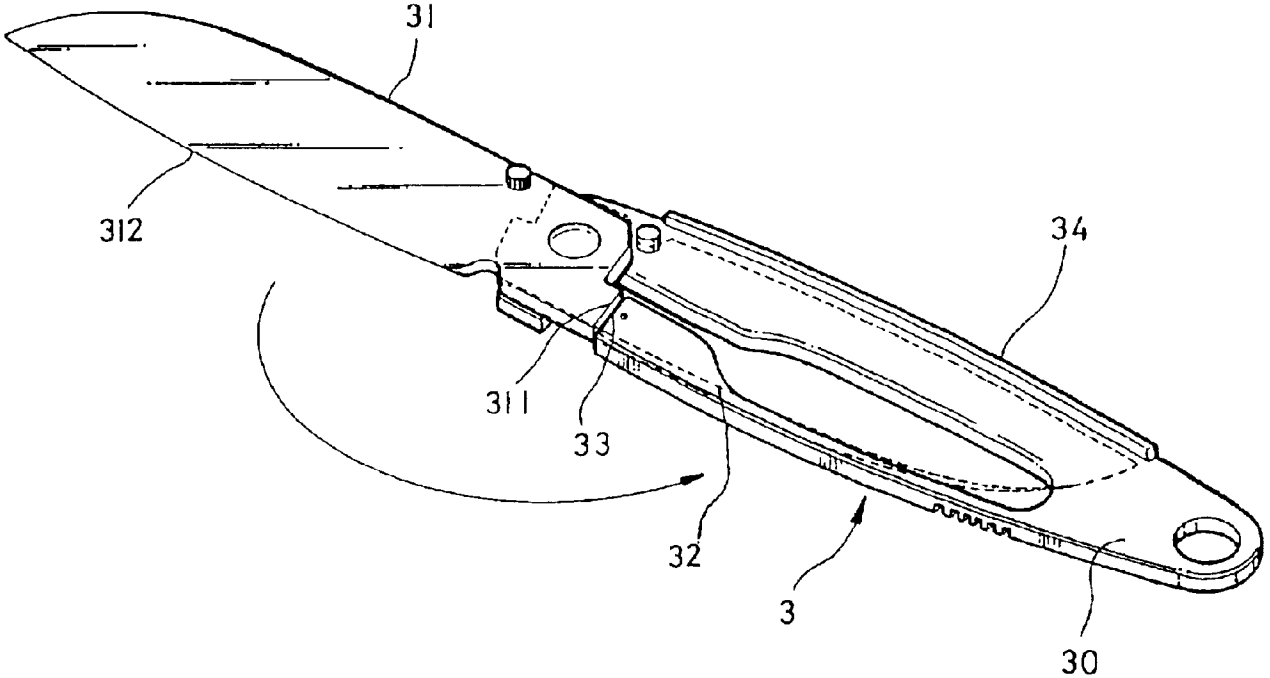
FIG. 2 (Prior Art)
FIG. 2 is a perspective view of another conventional foldable knife, showing the blade of the knife in its opened position.
Figure 3:
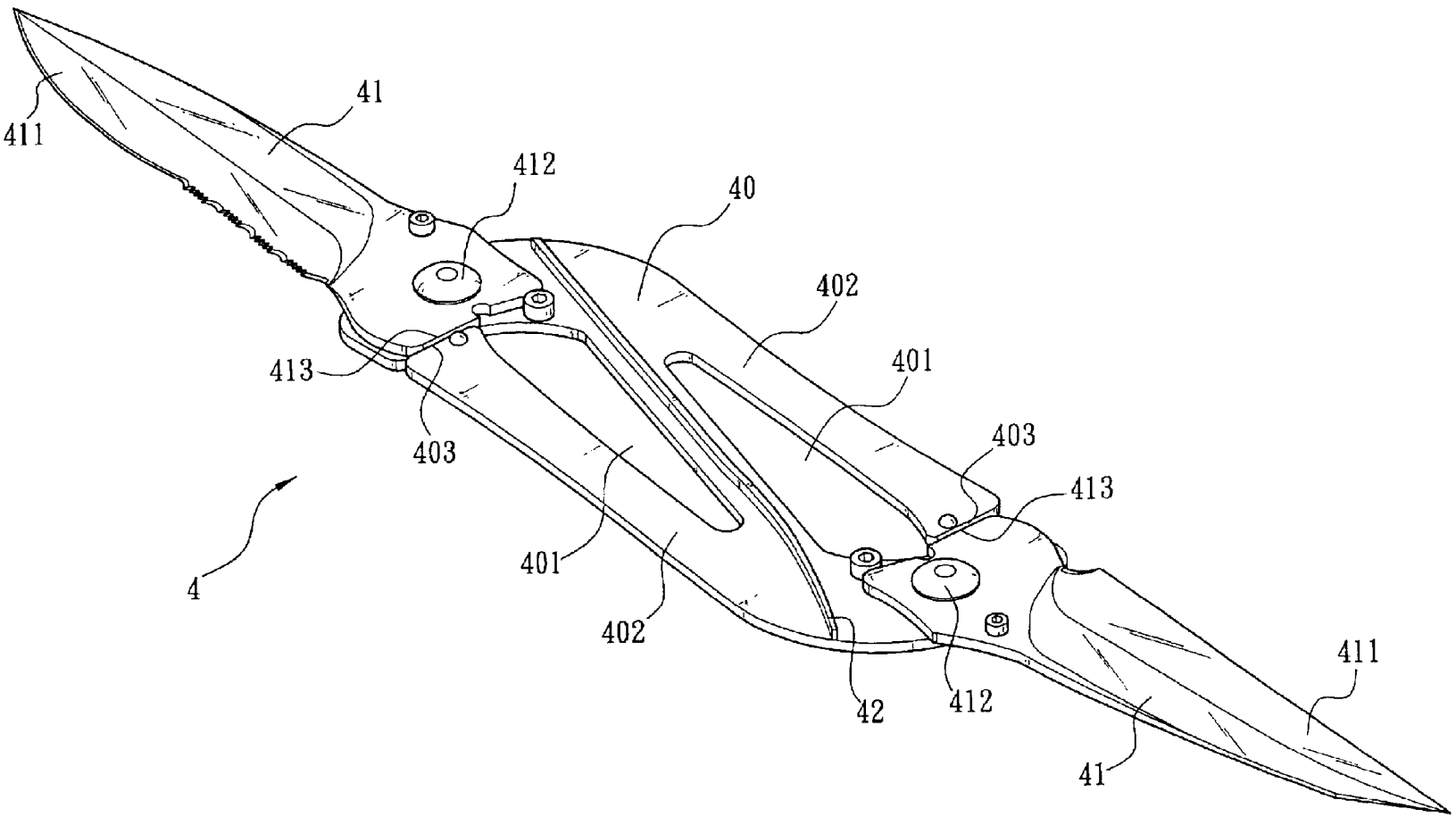
FIG. 3 is a perspective view of a foldable knife having a double blade according to the invention, showing the blades of the knife in its opened position.

Referring to FIG. 3, there is shown a foldable knife 4 in accordance with the invention. The knife 4 comprises a flat handle 40, two opposite blades 41 pivotably coupled to forward and rear ends of the handle 40 respectively, each blade 41 having a cutting edge 411, a pivot member 412 pivotably coupled to the handle 40, and a latch 413 in a rear end, two spaced openings 401 through the handle 40, and two resilient pieces 402 on two opposite sides of the handle 40, each resilient piece 402 having one end coupled to the handle 40 and the other end spaced from the handle 40 by a small distance, the other end of the resilient piece 402 being slightly curved upward to form a stop 403. The stop 403 is engaged with the latch 413 of the blade 41 when the blade 41 is fully extended. At this time, the blade 41 is locked in an opened position.

As shown in FIGS. 3-7, the blades 41 are positioned on a same plane of the handle 40.

Figure 4:
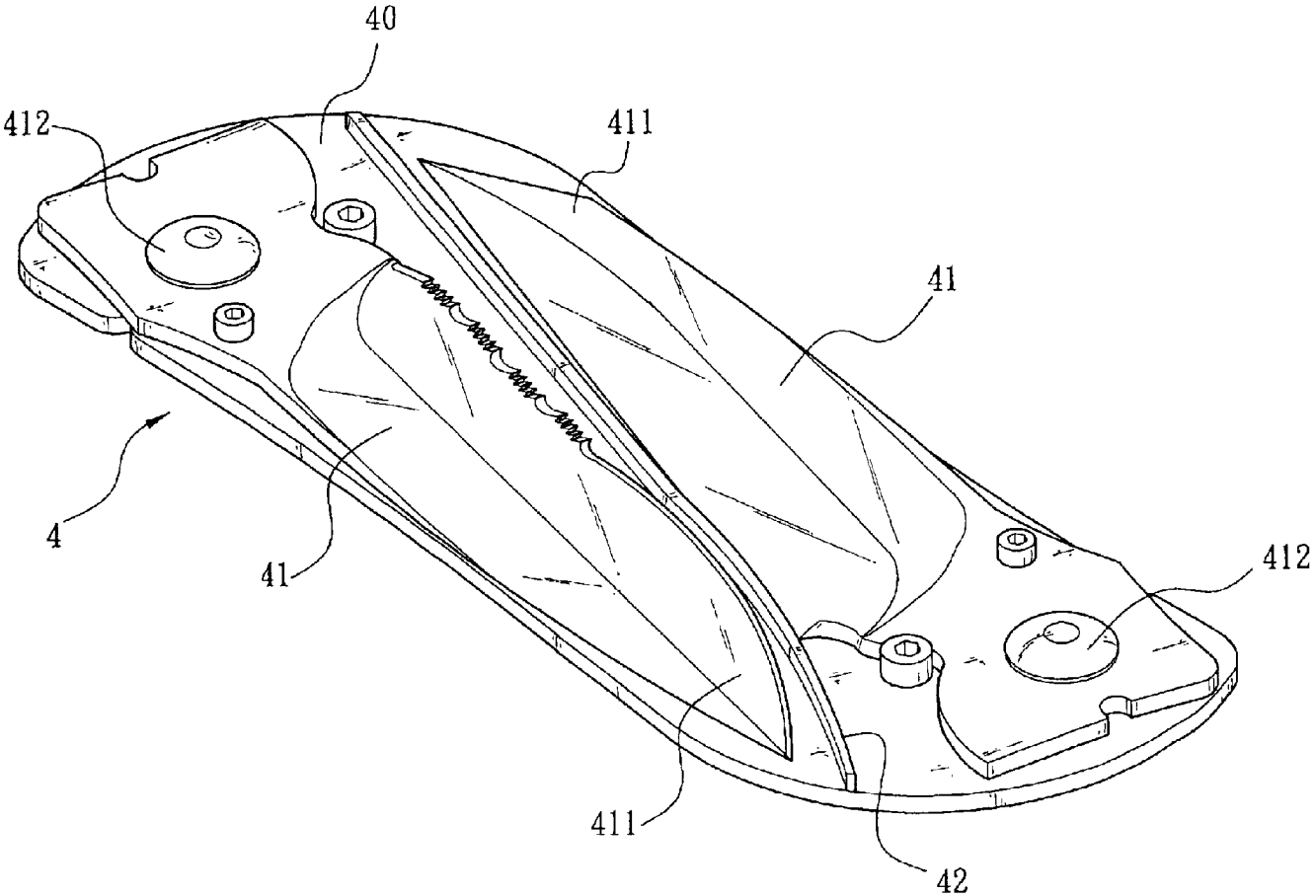
FIG. 4 is a perspective view of a first preferred embodiment of a foldable knife having a double blade according to the invention, showing the blades of the knife in its closed position.

Referring to FIG. 4 in conjunction with FIG. 3, in a first preferred embodiment of the invention a protective element 42 is disposed between the openings 401 and on a top of the handle 40 being pivotably coupled to the blade 41. The protective element 42 is an elongate projection and has a predetermined height sufficient to prevent the cutting edges 411 of the blades 41 from contacting the hand of the user when the blades 41 are in a closed position. Hence, the protective element 42 can prevent the user's hand from being hurt by the cutting edges 411 while taking or carrying the knife 4. Further, other objects can also be protected (i.e., prevent they from being hurt by the cutting edges 411) when they are stored together with the knife 4. Furthermore, with the provision of the protective element 42, the cutting edges 411 itself can be prevented from being damaged by other objects.

Figure 5:
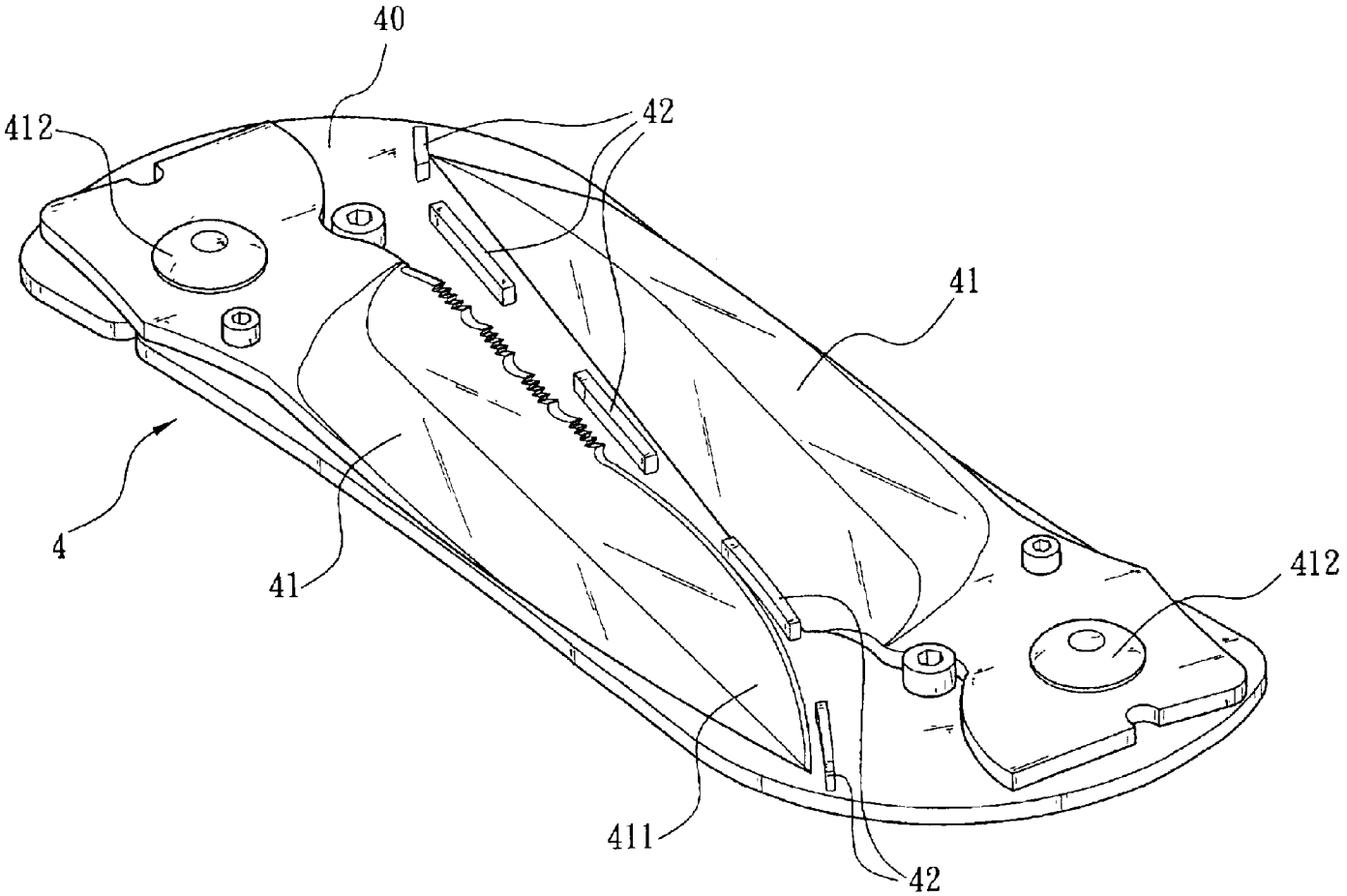
FIG. 5 is a perspective view of a second preferred embodiment of a foldable knife having a double blade according to the invention, showing the blades of the knife in its closed position.

Referring to FIG. 5, in a second preferred embodiment of the invention the protective element 42 is comprised of a plurality of equally spaced risers each having a predetermined height and a section of rectangular (as shown) or any of other shapes. Preferably, a spacing between any two adjacent risers is designed to prohibit the hand of the user from being hurt by the cutting edges 411 while holding the knife 4. The provision of risers has the benefits of saving material and reducing manufacturing cost in addition to its protective purpose.

Figure 6:
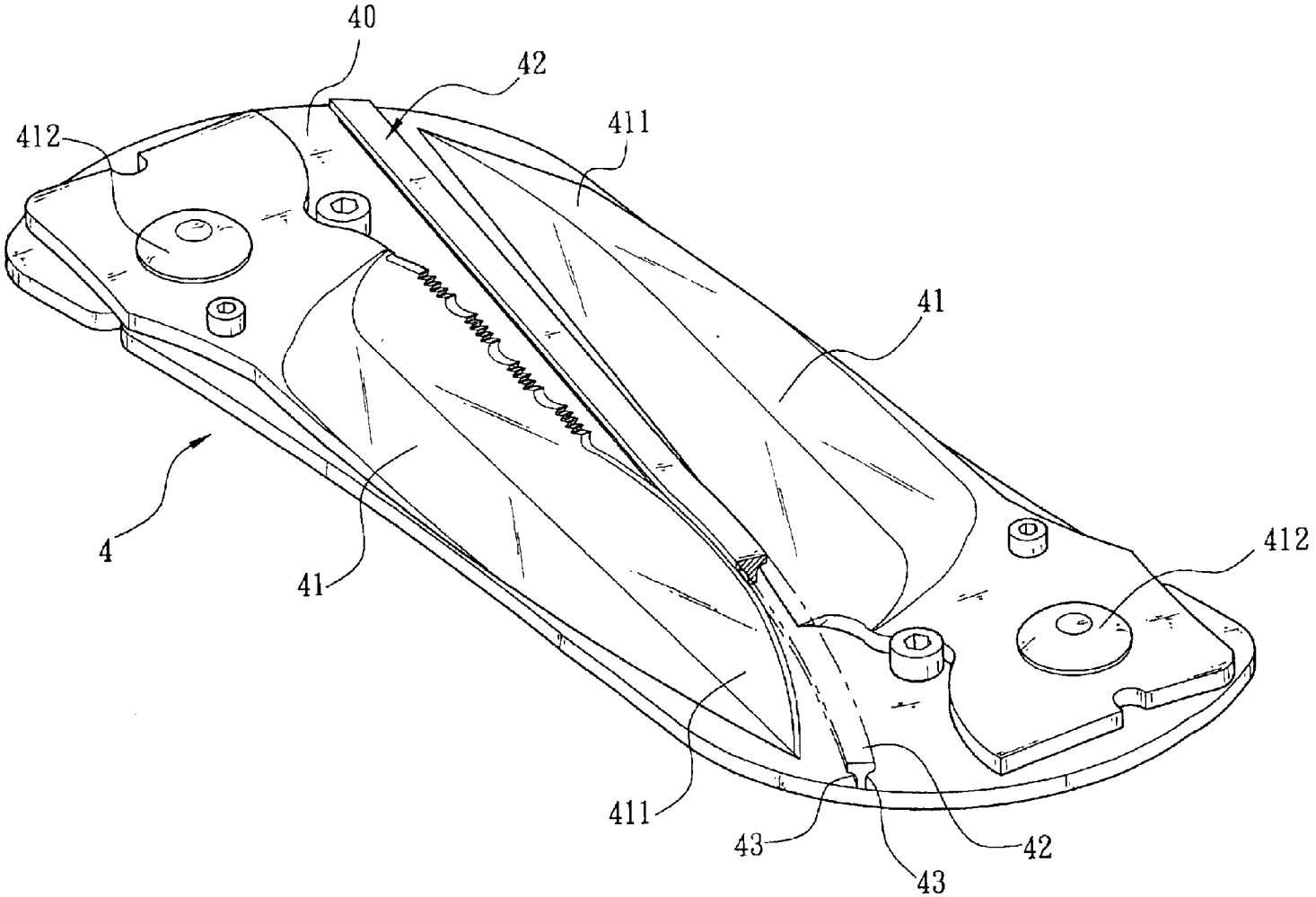
FIG. 6 is a perspective view of a third preferred embodiment of a foldable knife having a double blade according to the invention, showing the blades of the knife in its closed position.

Referring to FIG. 6, a third preferred embodiment of the invention is shown. The characteristics of the fourth preferred embodiment are detailed below. The elongated protective element 42 has two lengthwise grooves 43 each facing either cutting edge 411 in the closed position of the knife 4. As shown, the protective element 42 has a section of substantially T. In the closed position of the knife 4, the cutting edge 411 of each blade 41 is substantially received in the groove 43. The provision of grooves 43 can also prevent the hand of the user from being hurt by the cutting edges 411 while holding the knife 4.

Figure 7:
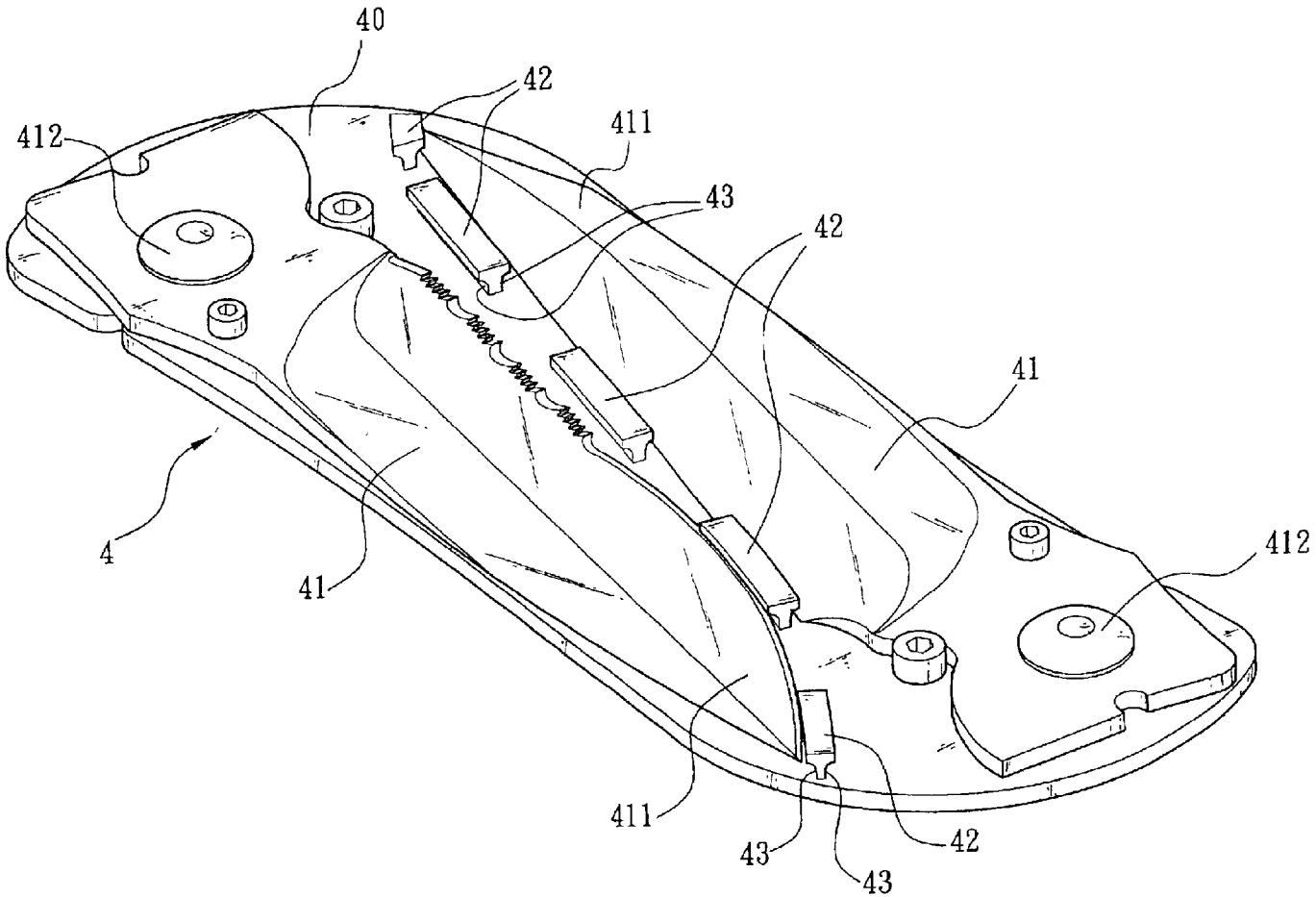
FIG. 7 is a perspective view of a fourth preferred embodiment of a foldable knife having a double blade according to the invention, showing the blades of the knife in its closed position.

Referring to FIG. 7, in a fourth preferred embodiment of the invention is shown. The difference between the third the fourth preferred embodiments is that the protective element 42 is formed as a plurality of risers each has two lengthwise grooves 43 each facing either cutting edge 411. As shown, each riser has a section of substantially T. In the closed position of the knife 4, the cutting edge 411 of each blade 41 is received in the groove 43. The provision of grooves 43 can further prevent the hand of the user from being hurt by the cutting edges 411 while holding the knife 4.

Referring to FIG. 3 again, in each preferred embodiment of the invention the knife 4 has two blades 41 in which one of the blades 41 has a series of sharp teeth in its cutting edge 411. With such variety of cutting edges, the foldable knife 4 of the invention can be readily adapted to any of other environments.

While the invention has been described by means of specific embodiments, numerous modifications and variations could be made thereto by those skilled in the art without departing from the scope and spirit of the invention set forth in the claims.

What is claimed is:

1. A foldable knife comprising:

a flat handle including two spaced openings therethrough and two resilient pieces on two opposite sides of the handle, each of the resilient pieces having one end coupled to the handle and the other end spaced from the handle, the other end of each of the resilient pieces being slightly curved upwards to form a stop;

two opposite blades pivotably coupled to forward and rear ends of the handle respectively, wherein the blades are positioned on a first plane of the handle and each of the blades having a cutting edge, a pivot member pivotably coupled to the handle, and a latch in a rear end thereof, the stop being engaged with the latch when the respective one of the blades is fully extended so as to lock the blade in an opened position; and a protective element disposed on the first plane of the handle between the openings and on a surface of the handle that is pivotably coupled to the blades.

2. The foldable knife of claim 1, wherein the protective element is an elongate projection and has a predetermined height sufficient to prevent the cutting edges of the blades from contacting a user's hand when the blades are in the closed position.

3. The foldable knife of claim 2, wherein the protective element comprises two lengthwise grooves each facing either cutting edge so as to include a section of substantially T-shape and in a closed position of the foldable knife, the cutting edge of each of the blades is substantially received in the groove.

4. The foldable knife of claim 1, wherein the protective element is comprised of a plurality of equally spaced risers each having a predetermined height.

5. The foldable knife of claim 4, wherein each of the risers comprises two lengthwise grooves each facing either one of the cutting edge so as to include a section of substantially T-shape and in a closed position of the knife, the cutting edge of each blade is substantially received in the groove.

6. The foldable knife of claim 5, wherein a spacing between any two adjacent risers has a length to prevent a hand of a user from being hurt by the cutting edges while holding the knife.

7. The foldable knife of claim 1, wherein the cutting edge of one of the blades is formed of a series of sharp teeth.

* * * * *